United States Patent [19]

Ricks

[11] 4,209,303

[45] Jun. 24, 1980

[54] METHOD AND APPARATUS FOR RECOVERY OF COMBUSTIBLE GAS FROM WASTE

[76] Inventor: Jay W. Ricks, 4121 Cambridge Dr., Bakersfield, Calif. 93306

[21] Appl. No.: 940,862

[22] Filed: Sep. 8, 1978

[51] Int. Cl.[2] ..... C10J 3/00

[52] U.S. Cl. ..... 48/111; 48/209; 435/166; 435/316; 98/115 R; 219/311; 220/325; 210/12; 210/180

[58] Field of Search ..... 48/197 A, 111, 209, 48/61; 210/2, 12, 177, 180; 195/27; 71/10; 219/311; 98/115 R; 220/327, 328, 325; 435/166, 287, 316

[56] References Cited

U.S. PATENT DOCUMENTS

| | | | |
|---|---|---|---|
| 1,988,589 | 1/1935 | Gaston | 220/325 |
| 1,990,523 | 2/1935 | Bushwell et al. | 48/197 A |
| 2,013,914 | 9/1935 | Hartmann | 219/311 |
| 2,189,127 | 2/1940 | Brannon | 219/311 |
| 3,338,826 | 8/1967 | Kramer | 210/12 |
| 3,973,043 | 8/1976 | Lynn | 195/27 |
| 4,050,907 | 9/1977 | Brimhall | 48/197 A |
| 4,053,395 | 10/1977 | Switzgable | 210/12 |

FOREIGN PATENT DOCUMENTS

| | | | |
|---|---|---|---|
| 1528932 | 5/1967 | France | 219/311 |

*Primary Examiner*—S. Leon Bashore
*Assistant Examiner*—Michael Goldman
*Attorney, Agent, or Firm*—Clarence A. O'Brien; Harvey B. Jacobson

[57] ABSTRACT

A method and apparatus is disclosed for recovery of combustible gas formed from combustible refuse or vegetable matter in an enclosed space from which the combustible gas is collected. Water can be injected into the apparatus and the decay process initiated and promoted by activating a heating element projecting upwardly from the base of the apparatus into the material undergoing decomposition. The combustible gas contains a substantial proportion of methane.

6 Claims, 7 Drawing Figures

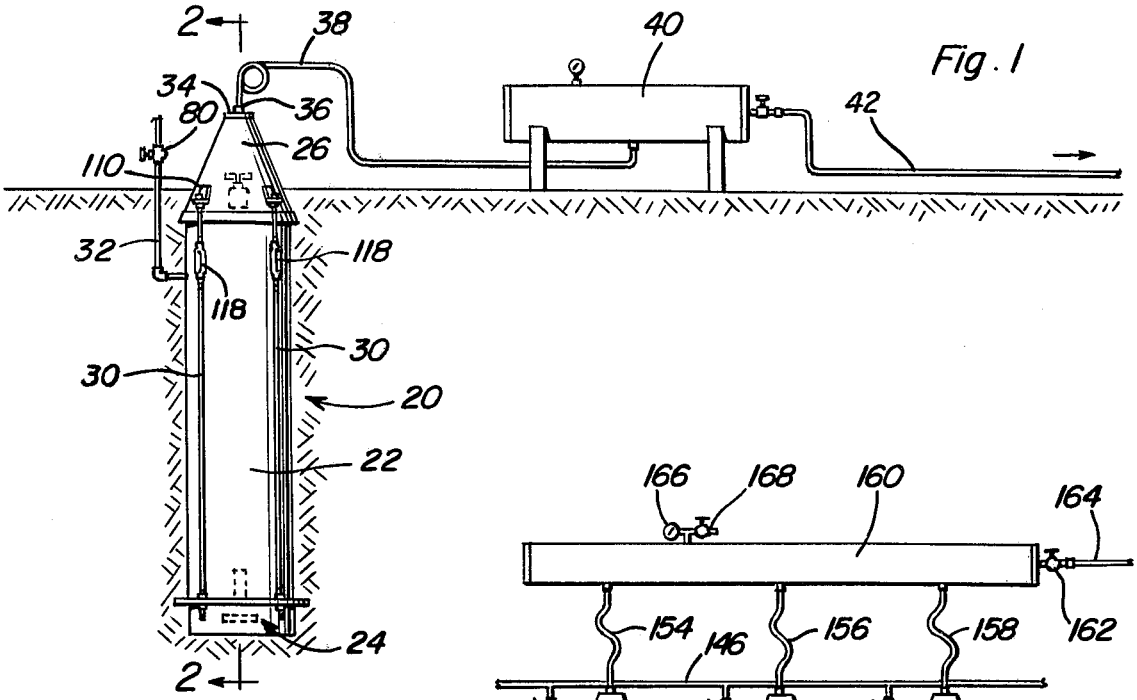
Fig. 1
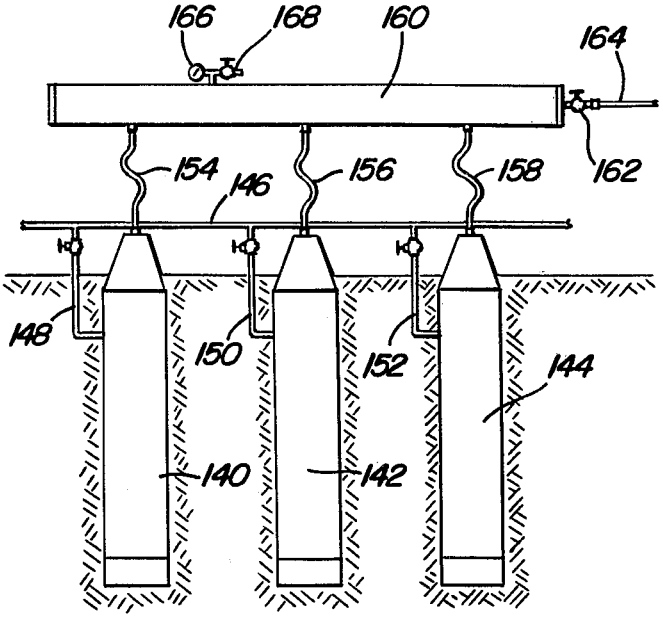
Fig. 7
Fig. 3
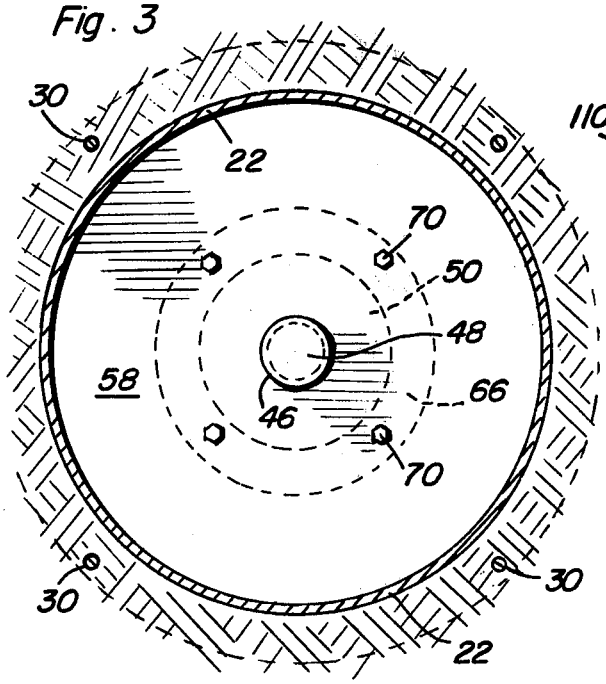
Fig. 4
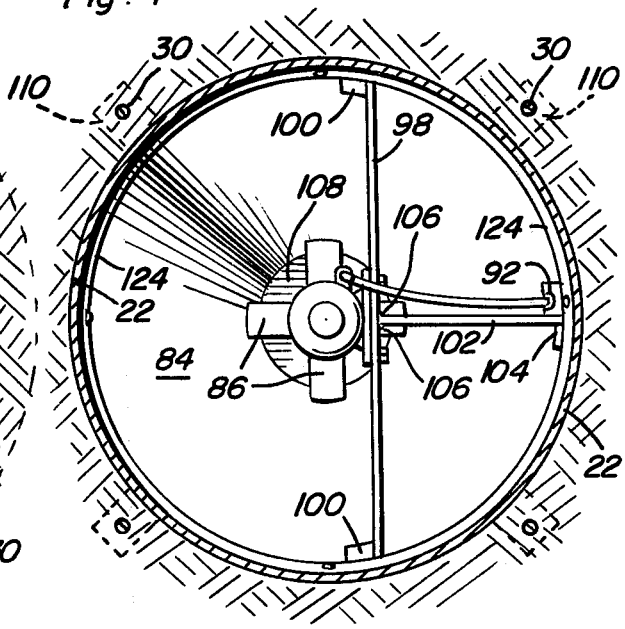

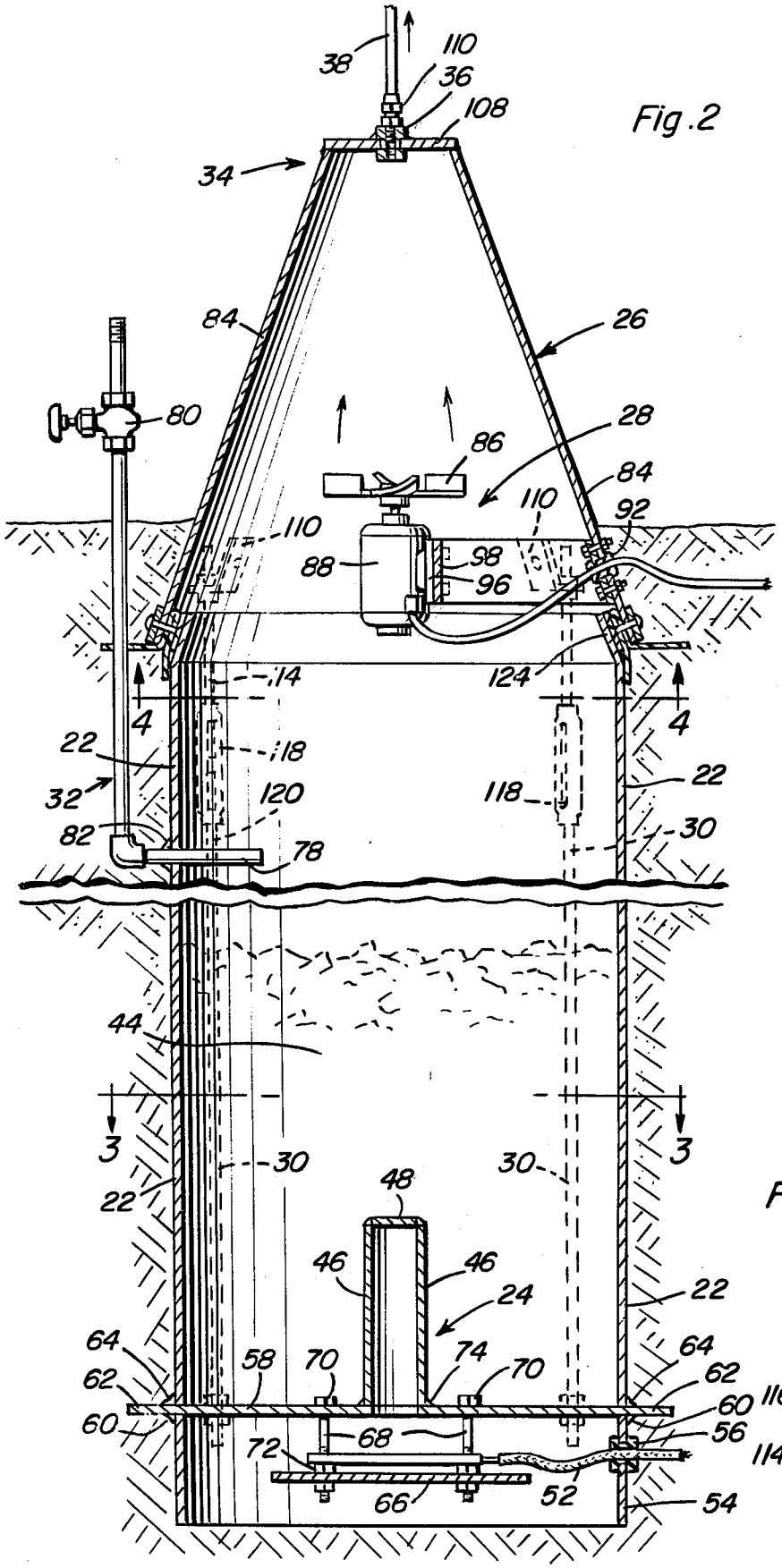
Fig. 2
Fig. 5
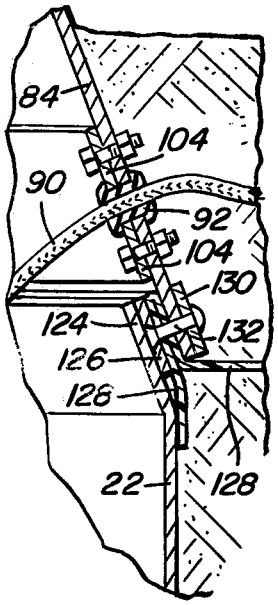
Fig. 6
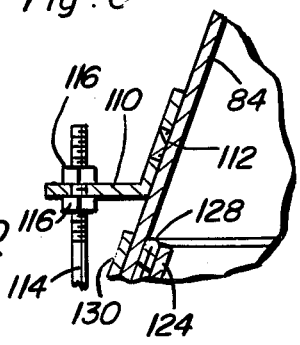

METHOD AND APPARATUS FOR RECOVERY OF COMBUSTIBLE GAS FROM WASTE

BACKGROUND OF THE INVENTION

1. Field of the Invention

The invention relates to apparatus and a method for operating the apparatus whereby combustible gas useful for cooking, lighting, heating, or other purposes can be formed by decomposition of combustible refuse or vegetable matter. Collecting means is provided for collecting combustible gas produced, including a substantial proportion of methane. Means for injecting water, and means for heating the material undergoing decomposition are provided.

2. Description of the Prior Art

Methods to produce methane from organic waste materials, sewage sludge, woody material, greases, and other wastes are known. For example, Teichmann et al in U.S. Pat. No. 3,671,209, issued June 20, 1972, add a fluid such as water to bits of garbage or solid waste matter to produce a pumpable feed mixture stream, which can be preheated and reacted by partial oxidation with a stream of oxygen-rich gas to produce a stream of synthesis gas, fuel gas, and other materials.

Buswell et al in U.S. Pat. No. 1,990,523, issued Feb. 12, 1935, produce methane by controlled bacterial decomposition of cellulosic material such as cornstalks by controlled and regulated bacterial action.

Switzgable in U.S. Pat. No. 4,053,395, issued Oct. 11, 1977, utilizes a plurality of airtight tanks for processing a slurry of biodegradable waste materials, one of the tanks being provided with a cathode and another with an anode for conducting electrolysis reactions to produce hydrogen, which can further react to produce methane.

Other patents showing production of methane in treatment of sewage sludge or other organic waste materials include the following:

- U.S. Pat. No. 1,717,100—J. W. Downes—June 11, 1919
- U.S. Pat. No. 3,368,967—T. O Weaver et al—Feb. 13, 1968
- U.S. Pat. No. 3,687,646—A. Brent et al—Aug. 29, 1972
- U.S. Pat. No. 4,057,401—O. W. Boblitz—Nov. 8, 1977

SUMMARY OF THE INVENTION

The invention provides an upright airtight tank with a conical cap placed over the tank and joined to it near or at ground level. A heating assembly is provided at the bottom of the tank with transfer of heat into the tank contents facilitated by an upward projection into combustible refuse contained therein. Water can be controllably injected into the refuse contained within the tank from a line entering the tank from the outside. Collection of gas produced during decay and decomposition of the organic matter is facilitated by a fan assembly at the base of the cone to force evolved gas upwardly toward the nose of the cone, where the gas exits into a line leading to a holding reservoir for ultimate disposition. A plurality of units can be arranged in parallel for simultaneous operation.

Accordingly, it is an object of the invention to provide a method and apparatus for disposal of combustible refuse, which would otherwise present a solid waste disposal problem.

Another object of the invention is to provide a method and apparatus for production of combustible gas useful for cooking, lighting, heating, or other purposes.

Still another object of the invention is to provide a fan assembly for efficient collection of combustible gas, and producing a slightly reduced pressure for decomposition of waste organic refuse.

Yet another object of the invention is to provide an apparatus for treatment of large quantities of combustible refuse by apparatus which is relatively unobtrusive and therefore adaptable for use in municipal or residential locations.

A further object of the invention is to provide an apparatus which is usable during all seasons in temperate regions such as exist in the United States.

Still a further object of the invention is to provide a waste disposal apparatus which when placed in operation requires minimum supervision, little maintenance, and is characterized by simplicity of design and construction.

Yet a further object of the invention is to provide a waste disposal apparatus which does not require enclosure within a building or other structure.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a schematic view of the single unit of the invention, showing its association with a collecting or receiving tank for gas produced during operation.

FIG. 2 is a sectional view of the gas generating apparatus, taken substantially upon a plane passing along section line 2—2 on FIG. 1.

FIG. 3 is a top sectional view looking downwardly upon a plane passing along section line 3—3 on FIG. 2.

FIG. 4 is a tranverse sectional view taken substantially upon a plane passing along section line 4—4 on FIG. 2, viewed upwardly to show details of the fan assembly.

FIG. 5 is a fragmentary enlarged sectional view of the joint between the cone assembly and the tank, showing details of the airtight seal for retention of gas inside the apparatus.

FIG. 6 is a fragmentary enlarged sectional view of a mounting bracket attached to the cone assembly, showing also the upper portion of an associated tie rod.

FIG. 7 is a schematic representation of a plurality of gas generating units attached in parallel to a collecting reservoir.

DESCRIPTION OF THE PREFERRED EMBODIMENT

The device of the present invention for generation of combustible gas from refuse is indicated generally by the numeral 20 in FIG. 1, and comprises tank 22, heater assembly 24, located in the lower portion of tank 22, cone assembly 26, and fan assembly 28, located near the base of cone assembly 26. Cone assembly 26 is detachable from tank 22 near its base for addition and replenishing of a supply of solid waste matter into tank 22, and is tightenable thereon by tie rods 30. Tank 22 and the lower portion of cone assembly 28 are located below grade in order to minimize potential nuisance problems to facilitate loading of combustible material into tank 22 and to prevent freezing during winter months if outside temperatures fall below 0 degrees C. Water inlet line 32 permits regulated injection of water into tank 22. Nose 34 of cone assembly 26 is provided with an attachment 36 for withdrawal of gas from inside nose 34 through pipeline 38, which carries gas to storage reservoir 40 for ultimate disposition through line 42.

Referring to FIG. 2, device 20 is shown in greater detail. Combustible refuse 44 fills the lower portion of tank 22 and absorbs heat from heater assembly 24 primarily by conduction from heater pipe 46, which is of sufficient diameter and height to allow the desired degree of heating to be furnished by conduction into the interior of the mass 44 of combustible refuse. Although the applicant does not wish to limit the utility of the present invention to specific dimensional characteristics, since many sizes and shapes are useful and operable, one possible construction of pipe 46 might have a diameter of about six inches, and a height of about twenty inches. Pipe 46 is sealingly capped with plate 48, welded about its periphery to pipe 46. Heating of the interior of pipe 46 is carried out by the provision of heating element 50, most conveniently a resistance heater element powered from a 110 volt power supply connected through asbestos insulated wire 52 to a source of power outside device 10. Wire 52 passes through heater hood 54 at grommet 56. Base plate 58 is welded to heater hood 54 at weldment 60, the outward extensions 62 of base plate 58 forming supports for engagement of the lower ends of tie rods 30. Tank 22 rests and is welded upon base plate 58 at weldment 64. Heater element 50 is dependingly held beneath base plate 58, resting upon heating unit support 66 by an appropriate insulator 68. Support 66 is held by bolts 68, which pass through base plate 58 at sealed heads 70, and which hold heating unit support 66 by double nuts 72 for adjustment of the distance between base plate 58 and heating element 50. A tight seal between pipe 46 and base plate 58 is guaranteed by weldment 74; consequently, passage of gaseous and liquid materials is prevented from the interior of tank 22, while passage of heat into the interior of pipe 46 and thence into the mass 44 of refuse contained in tank 22 is possible. Water can be controllably injected into tank 22 through water injection assembly 32 at inlet 78 by opening valve 80. Sealing grommet 82 insures an airtight seal between the interior of tank 22 and the outside.

Fan assembly 28, located near the bottom of cone assembly 26, forces gas evolved by decomposition of the mass of refuse 44 upwardly toward nose 34 of cone 84, as indicated by the arrows in FIG. 2. Fan assembly 28 comprises conventional fan blades 86 rotatably connected to fan motor 88, which is constructed from components which prevent ignition of any surrounding combustible mixture of gases. Such spark-free explosion-proof motors are well known in the art. Fan motor 88 is powered by asbestos insulated wire 90, passing through grommet 92 in cone 84. Motor mount 96 is bolted to motor support beam 98, which extends to opposite sides of cone 84 for fastening near the base by brackets 100. Further support is obtained from motor support 102, attached at bracket 104 to cone 84. Support beam 98 is welded to support 102 at weldments 106. Nose plate 108 is welded to cone 84 at nose 34 of cone assembly 26. Connector 36 is in turn welded to nose plate 108, and is threaded to receive angle bracket 110 for connecting with pipe line 38. Operation of fan assembly 28 serves to keep the interior of tank 22 under slightly reduced pressure, and, further, to help prevent accumulation of gases which are heavier than air, such as carbon dioxide, in tank 22.

The mechanism for assembly of cone assembly 26 and tank 22 is best illustrated in FIGS. 5 and 6, where angle bracket 110 is shown welded to cone 84 at plug weld 112. Upper segment 114 of tie rod 30 is held to angle bracket 110 by double nuts 116 for adjustable spacing of upper segment 114 longitudinally. Each of turnbuckles 118 permits tightening of upper segment 114 longitudinally with respect to lower segment 120 as cone assembly 26 is compressed downwardly upon neck 124 at the upper end of tank 22. During downward compression of cone assembly 26, support band 126 compresses neck 124 to provide a substantially leak-free joint. Plastic strip 128, which can be polyethylene, further assists in preventing escape of gases from within the apparatus. Support band 130 provides the gripping surface for the head of pop rivet 132, which holds the entire assembly at the base of cone 84 together for lowering on neck 124 during assembly. Adjustment of turnbuckles 118 permits uniform pressure to be applied between band 126 and neck 124, after which operation can commence.

FIG. 7 shows a plurality of the generating devices of the present invention, designated by the numerals 140, 142 and 144. Water inlet line 146 permits individually controllable injection of water through inlets 148, 150 and 152. Gas outlet lines 154, 156 and 158 lead to storage manifold 160, and shut-off valve 162 permits withdrawal of gas through outlet line 164, with pressure gauge 166 and relief valve 168, which can be conveniently set at about 60 pounds per square inch, also included on manifold reservoir 160.

Although the drawings show the apparatus situated primarily underground, with soil covering all but the upper portion of come assembly 26, it is to be understood that it is necessary to remove soil from the vicinity of the lower part of cone assembly 26 in order to gain access to turnbuckles 118 and removal of cone assembly 26. Accordingly, clearance space between the ground and tank 22, as well as the lower part of cone assembly 26, could be necessary to provide access for installation, maintenance, inspection or other purposes. Moreover, a layer of insulation surrounding tank 22 can be provided to retain heat as the contents undergo decay and decomposition.

In operation, with cone assembly 26 detached from tank 22, combustible refuse is loaded to the desired level in tank 22. Cone assembly 26 is then placed on neck 124 of tank 22 with brackets 110 in proper alignment over the lower portion 120 of tie rods 30. Double nuts 116 are adjusted to permit tightening of turnbuckles 118. After a close fit between support band 126 and neck 124 has been achieved by tightening of turnbuckles 118, a suitable quantity of water is injected through inlet 78 by opening valve 80, and valve 80 is closed. Activation of heating element 50 begins the decay process of mass 44 of refuse, and methane is liberated. After a quantity of methane has been liberated sufficient to displace air contained above refuse 24, fan assembly 28 is turned on to direct methane upwardly through pipeline 38 under a slight positive pressure, leaving refuse 44 under a slight negative pressure. The process is continued until decomposition of the supply of refuse 44 has been substantially completed, and the process can be repeated by removal of cone assembly 26 and replenishment of the supply of refuse 44 in tank 22.

As the principal constituent of natural gas, methane has wide utility for cooking, lighting, heating, operating combustion engines, and the like. Methane produced in the present invention can accordingly be used as a replacement for natural gas, having none of the drawbacks associated with certain synthetic gas mixtures, such as toxicity due to the presence of carbon monoxide, reliance upon fossil fuel energy sources, such as coal, which are presently or potentially in short supply, and the requirement for use of high temperatures or pressures to produce such artificial combustible gases.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A method for anaerobic decomposition of organic refuse to produce a combustible gas containing a substantial proportion of methane in an upright cylindrical tank having a cone assembly including a fan assembly mounted in the lower portion of said cone assembly, the cone assembly having an upright nose and a lower edge sealingly containing the top of the cylindrical tank, the cone assembly having tightenable tie rods extending from the lower portion of the cone assembly to the cylindrical tank, comprising the following steps:

(a) loading combustible refuse to a desired level in the tank and sealing the cone assembly to the cylindrical tank by tightening the tie rods;

(b) injecting water into the tank to form a mixture with the organic refuse;

(c) raising the temperature of at least a portion of the mixture to initiate decomposition thereof to generate initally produced gas and displacing air from the tank by the gas initially produced;

(d) allowing said mixture to decompose anaerobically to produce said combustible gas containing a substantial proportion of methane; and (e) collecting gas produced during said further decomposition of the refuse while regulating the temperature of said mixture until decomposition of the refuse is substantially complete, said gas being collected by directing the gas upwardly by the fan assembly toward the upright nose of the cone assembly, whereby the gas is removed at the upper portion of the nose at a slight positive pressure and said mixture is under a slight negative pressure.

2. The method of claim 1 wherein steps (c) and (e) further include controlling said temperature through heating means located in the bottom of said tank.

3. Apparatus for anaerobic decomposition of organic refuse into a gas containing a substantial proportion of methane comprising a tank, collecting means near the upper portion of said tank, and heating means near the lower portion of said tank, said heating means comprising a base plate having an upwardly projecting pipe sealed to the base plate around an aperture in the base plate, together with a heating element located beneath said base plate for transfer of heat interiorly into said pipe and thence from said pipe by conduction to the contents of the tank, said tank having injection means for controllably introducing water into said tank, whereby a desired degree of heating can be furnished deeply into the organic refuse by conduction through the pipe, the tank being an upright cylinder and said collecting means comprising a cone assembly having an upright nose and lower portion sealingly contacting the upper portion of said cylindrical tank, wherein said collecting means further comprises a fan assembly located in the upper portion of said cone assembly for directing gas upwardly toward said nose, the fan assembly including a spark-free explosion-proof motor mounted to a motor support beam and fastenable to opposite sides of the lower portion of said cone assembly, whereby said gas is upwardly directed by the fan assembly towards said nose, said gas being removable from said cone assembly at the nose, wherein further said cone assembly is sealingly attached to said tank by tension means between said base plate and mounting brackets on the lower portion of said cone assembly, said tension means comprising tie rods longitudinally tightenable by turnbuckles, whereby uniform sealing pressure is applicable between the tank and base plate.

4. The apparatus of claims 3 wherein said tank and lower portion of said cone assembly includes earthen insulating means surrounding the tank and lower portion of the cone assembly, whereby said apparatus is usable during all seasons in temperate regions.

5. A system for anaerobic decomposition of organic refuse to provide a gas containing a substantial portion of methane, the system comprising a plurality of apparatuses of claim 3 and a reservoir for receiving gas produced from said plurality of apparatuses.

6. The method of claim 2 wherein in step (c) said portion is located near the bottom and center of the cylindrical tank, the temperature being raised by an upwardly projecting pipe located in the lower portion of the tank and sealed from said contents thereof, together with a heating element for transferring heat to the interior of the pipe for further transferring heat by conduction through said pipe to said contents.

* * * * *